US006272992B1

(12) United States Patent
Chatley, Jr.

(10) Patent No.: US 6,272,992 B1
(45) Date of Patent: Aug. 14, 2001

(54) POWER SPOT IGNITION DROPLET

(75) Inventor: Glenn R. Chatley, Jr., Reno, NV (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/275,555

(22) Filed: Mar. 24, 1999

(51) Int. Cl.[7] ..... F42C 11/00; F42B 3/10

(52) U.S. Cl. ..... 102/202.5; 102/202.7; 102/202.9; 149/2; 149/110; 149/19.1; 280/741; 280/740

(58) Field of Search ..... 149/2, 76, 110, 149/19.1; 280/740, 741; 102/202.5, 202.7, 202.9

(56) References Cited

U.S. PATENT DOCUMENTS

| | | | | |
|---|---|---|---|---|
| 1,890,112 | | 12/1932 | Fisher . | |
| 2,821,139 | | 1/1958 | Apstein et al. | 102/70.2 |
| 2,900,242 | | 8/1959 | Williams . | |
| 3,017,300 | | 1/1962 | Herring . | |
| 3,999,484 | * | 12/1976 | Evans | 102/28 |
| 4,050,347 | * | 9/1977 | Adelman et al. | 149/14 |
| 4,065,519 | * | 12/1977 | Koch | 260/857 |
| 4,102,953 | * | 7/1978 | Johnson et al. | 149/19.8 |
| 4,180,424 | * | 12/1979 | Reed, Jr. et al. | 149/19.4 |
| 4,486,641 | * | 12/1984 | Ruffini | 219/10.79 |
| 4,529,801 | * | 7/1985 | Norris | 548/126 |
| 5,411,615 | * | 5/1995 | Sumrail et al. | 149/47 |
| 5,472,529 | * | 12/1995 | Arita et al. | 149/2 |
| 5,538,569 | * | 7/1996 | Carter | 149/105 |
| 5,665,276 | * | 9/1997 | Kirby et al. | 264/3.1 |
| 5,939,660 | * | 8/1999 | Fogle, Jr. | 102/202.7 |

* cited by examiner

*Primary Examiner*—Charles T. Jordan
*Assistant Examiner*—Glenda L. Sánchez
(74) *Attorney, Agent, or Firm*—Tarolli, Sundheim, Covell, Tummino & Szabo L.L.P.

(57) ABSTRACT

An electrically actuatable igniter (24) includes a body (60), a pair of electrodes (40) and (42) associated with the body (60), a heating element (44) electrically connected between the electrodes (40) and (42), and an ignition droplet (46) covering and adhering to said heating element (44). The ignition droplet (46) comprises a particulate pyrotechnic material and a particulate polymeric resin binder. The particles (112) of the polymeric resin binder are fused together and form a structure having interconnected open cells (118). The particles (114) of pyrotechnic material are disposed within the interconnected open cells (118) and form a combustible network of pyrotechnic material.

11 Claims, 1 Drawing Sheet

POWER SPOT IGNITION DROPLET

FIELD OF THE INVENTION

The present invention relates to an igniter and method of making an igniter, and particularly relates to an ignition material for an igniter for inflating an inflatable vehicle occupant protection device.

BACKGROUND OF THE INVENTION

An inflatable vehicle occupant protection device, such as an air bag, is inflated by inflation gas provided by an inflator. The inflator typically contains ignitable gas generating material. The inflator further includes an igniter to ignite the gas generating material.

The igniter contains a charge of ignition material. The igniter also contains a bridgewire which is supported in a heat transferring relationship with the ignition material. When the igniter is actuated, an actuating level of electric current is directed through the become resistively heated sufficiently to ignite the ignition material. The ignition material then produces combustion products which, in turn, ignite the gas generating material.

SUMMARY OF THE INVENTION

The present invention is an electrically actuatable igniter which comprises a body, a pair of electrodes associated with the body, a heating element electrically connected between the electrodes, and an ignition droplet covering and adhering to the heating element. The ignition droplet comprises a particulate pyrotechnic material and a particulate polymer resin binder. The particles of polymeric resin binder are fused together and form a structure having interconnected open cells. The particles of pyrotechnic material are disposed within the interconnected open cells and form a combustible network of pyrotechnic material.

BRIEF DESCRIPTION OF THE INVENTION

The foregoing and other features of the invention will become more apparent to one skilled in the art upon consideration of the following description of the invention and the accompanying drawings in which.

DESCRIPTION OF THE INVENTION

Figure 1:
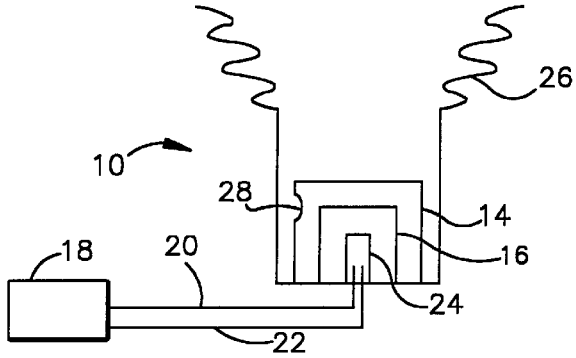
FIG. 1 is a schematic view of a vehicle occupant protection apparatus embodying the present invention.

Referring to FIG. 1, an apparatus 10 embodying the present invention includes an inflator 14 and an inflatable vehicle occupant protection device 26. The inflator 14 contains a gas generating composition 16. The gas generating composition 16 is ignited by an igniter 24 operatively associated with the gas generating composition 16. Electric leads 20 and 22 convey electric current to and from the igniter 24. The electric current is conveyed to the igniter 24 through a crash sensor 18 from a power source (not shown). The crash sensor 18 is responsive to vehicle deceleration indicative of a collision. A gas flow means 28, such as an opening in the inflator 14, conveys gas, which is generated by combustion of the gas generating composition 16, to the vehicle occupant protection device 26.

A preferred vehicle occupant protection device 26 is an air bag which is inflatable to help protect a vehicle occupant in the event of a collision. Other vehicle occupant protection devices which can be used with the present invention are inflatable seat belts, inflatable knee bolsters, inflatable air bags to operate knee bolsters, inflatable head liners, and inflatable side curtains.

Figure 2:
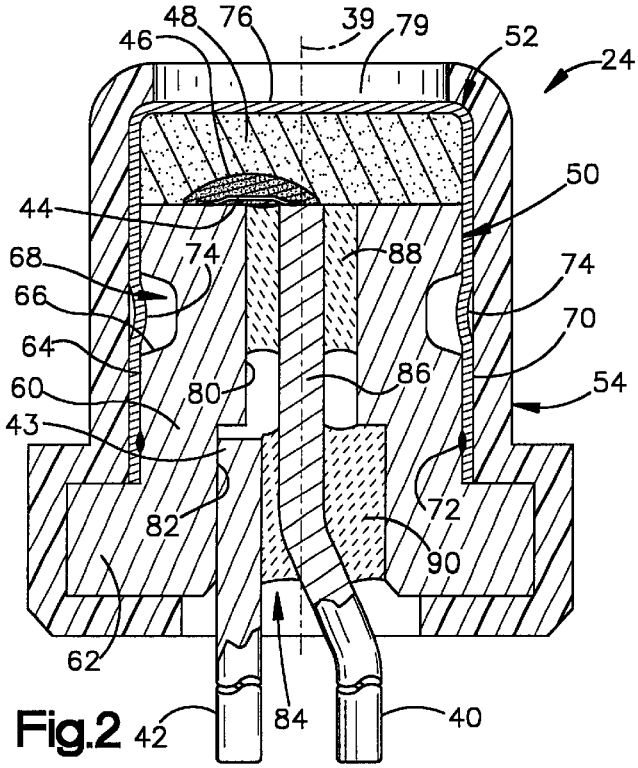
FIG. 2 is an enlarged sectional view of a part of the apparatus of FIG. 1.

Referring to FIG. 2, the igniter 24 has a central axis 39 and a pair of axially projecting electrodes 40 and 42. A heating element in the form of a bridgewire 44 is electrically connected between the electrodes 40 and 42 within the igniter 24. An ignition droplet 46 and a main pyrotechnic charge 48 are contained within the igniter 24. The pyrotechnic charge 48 is contained around the ignition droplet 46 so that it is in a heat receiving relationship with the ignition droplet 46. The ignition droplet 46 surrounds and is in contact with the bridgewire 44 so that it is in a heat receiving relationship with the bridgewire 44.

The igniter 24 further includes a header 50, a charge cup 52 and a casing 54. The header 50 is a metal part, preferably made of 304L steel, with a generally cylindrical body 60 and a circular flange 62 projecting radially outward from one end of the body 60. A cylindrical outer surface 64 of the body 60 has a recessed portion 66 defining a circumferentially extending groove 68.

The charge cup 52 also is a metal part, and has a cylindrical side wall 70 received in a tight fit over the body 60 of the header 50. The side wall 70 of the charge cup 52 is fixed and sealed to the body 60 of the header 50 by a circumferentially extending weld 72. The charge cup 52 is further secured to the header 50 by a plurality of circumferentially spaced indented portions 74 of the side wall 70 which are crimped radially inward into the groove 68. In this arrangement, the side wall 70 and a circular end wall 76 of the charge cup 52 together contain and hold the main pyrotechnic charge 48 in a heat transferring relationship with the ignition droplet 46. A plurality of thinned portions (not shown) of the end wall 76 function as stress risers which rupture under the influence of the combustion products generated by the main pyrotechnic charge 48. The casing 54 is a sleeve-shaped plastic part which is shrink fitted onto the header 50 and the ignition cup 52 so as to insulate and partially encapsulate those parts. An opening 79 in the casing 54 allows combustion products escaping through the ruptured thinned portions of the cup 52 to exit the igniter 24.

The header 50 has a pair of cylindrical inner surfaces 80 and 82 which are aligned and together define a central passage 84 extending fully through the header 50. The first electrode 40 has an inner end portion 86 extending along the entire length of the central passage 84. A pair of axially spaced apart glass seals 88 and 90 surround the first electrode 40 in the central passage 84, and electrically insulate the first electrode 40 from the header 50 and from the electrode 42. Preferably, the glass seals 88 and 90 are formed from a barium alkali silicate glass. The electrode 42, at one end 43, seats against the header 50 in direct contact with the header 50.

Figure 3:
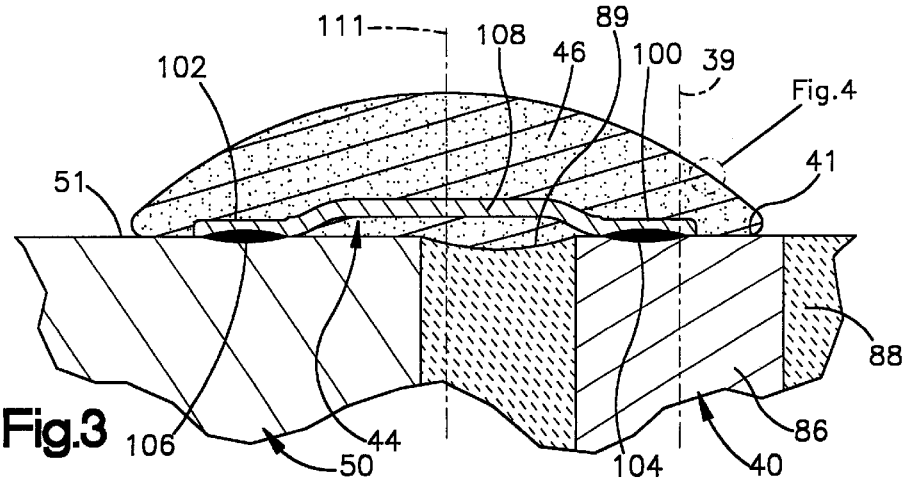
FIG. 3 is an enlarged, partial, sectional view of a part of FIG. 2.

As shown in FIG. 3, the bridgewire 44 extends from a radially extending surface 41 of the first electrode 40 to a radially extending surface 51 of the header 50. The bridgewire 44 has flattened opposite end portions 100 and 102 which are fixed to the electrode surface 41 and the header surface 51 by electrical resistance welds 104 and 106, respectively. Opposite end portions 100 and 102 of the bridgewire 44 become flattened under the pressure applied by the welding electrodes (not shown) that are used to form the resistance welds 104 and 106. The bridgewire 44 thus has an unflattened major portion 108 extending between the opposite end portions 100 and 102. The major portion 108 of the bridgewire 44 is bent so that the major portion 108 lies in a plane spaced from the plane of the opposite end portions 100 and 102 and from a radially extending surface 89 of the first glass seal 88 and the header surface 51.

The bridgewire 44, in one embodiment, is formed from a high resistance metal alloy. A preferred metal alloy is "NICHROME", a nickel-chromium alloy. Other suitable alloys for forming a high resistance bridgewire 44 include platinum-tungsten and 304L steel. An electrical current flow in the bridgewire 44 resistively generates heat to ignite the ignition droplet 46.

A monolithic bridge may be used in place of the bridgewire 44. A monolithic bridge consists of dissimilar conductive materials such as a thick resistive film on a ceramic substrate, a thin resistive film deposited on a ceramic substrate, or a semiconductor junction diffusion doped onto a silicon substrate. A current flow in the monolithic bridge generates heat to ignite the ignition droplet 46. Examples of monolithic bridges include: a substrate which is formed of ceramic material such as dense alumina ($Al_2O_3$), beryllia (BeO), or steatite and an alloy such as nickel-chrome, phosphorous-chrome, or tantalum nitride on the substrate.

The ignition droplet 46 of the present invention is shown in detail in FIG. 3. FIG. 3 is an enlarged, partial, sectional view of the igniter 24 in a partially assembled condition in which the ignition droplet 46 has been installed on the bridgewire 44 before the charge cup 52 (which contains the main pyrotechnic charge 48) is installed over the header 50.

The ignition droplet 46 has a flattened dome shape. By flattened dome shape, it is meant substantially the shape of a segment of a sphere with a generally circular periphery centered on axis 111, and with an arcuate radial profile generally symmetrical about axis 111. More specifically, the ignition droplet 46 has a configuration substantially as shown in FIG. 3.

The ignition droplet 46 of the present invention is made of a uniform blend of a particulate polymeric resin binder and a particulate pyrotechnic material.

The ignition droplet 46 is formed by mixing particles of the polymeric resin binder with particles of the pyrotechnic material using conventional powder mixing methods. The particles of polymeric resin binder and particles of pyrotechnic material may be mixed dry or may be added to a liquid carrier, in which neither the polymeric resin binder nor the pyrotechnic material is soluble, and mixed wet to form a viscous slurry. An example of a suitable liquid carrier is an alcohol, preferably ethyl alcohol.

The ignition droplet 46 is installed on the bridgewire 44 by depositing a pre-determined amount of the mixture of particles of pyrotechnic material and particles of polymeric resin binder over the bridgewire 44. The ignition droplet 46 may be deposited in a wet state as a viscous slurry from a dispensing system positioned over the bridgewire 44. When deposited in a wet state from a dispensing system, the droplet is initially spherical, but the liquid in the slurry wets the surfaces which are contacted by the droplet, causing the droplet to adopt the semi-spherical configuration of FIG. 3.

The ignition droplet 46 after being deposited on the bridgewire 44 is heated to a temperature and for an amount of time sufficient to bond together particles of polymeric resin binder. This heating also causes the particles of the polymeric resin binder to adhere to the bridgewire 44, the header surface 51, the electrode surface 41, and the glass seal surface 89. If the ignition droplet 46 is in a wet state during dispensing, the ignition droplet is heated to a first temperature sufficient to drive the liquid carrier from the particle mixture. The ignition droplet 46 is then heated to a second temperature sufficient to bond the particles of the polymeric resin binder together as well as bond the ignition droplet 46 to the bridgewire 44, the header surface 51, the electrode surface 41, and the glass seal surface 89.

Figure 4:
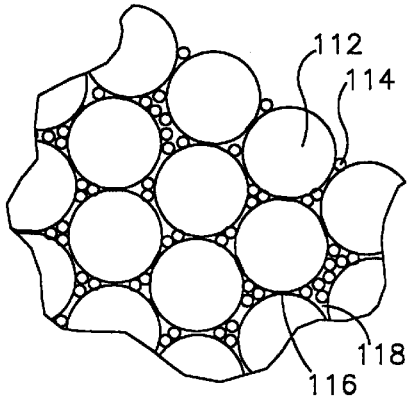
FIG. 4 is an enlarged, schematic, partial, sectional view of the ignition droplet in FIG. 3.

The structure of the ignition droplet 46 is shown in FIG. 4. FIG. 4 is an enlarged, schematic, partial, sectional, representation of the particles 112 of polymeric resin binder and the particles 114 of pyrotechnic material in the ignition droplet 46.

The particles 112 of polymeric resin binder in the ignition droplet 46 have a substantially uniform shape which is essentially spherical. The average diameter of the particles 112 of polymeric resin binder is preferably within the range of about 80 microns to about 200 microns. Preferably, the particles 112 of polymeric resin binder have an average diameter of about 80 microns.

The particles 114 of pyrotechnic material in the ignition droplet 46 also have a substantially uniform shape which is essentially spherical. Preferably, the average diameter of the particles 114 of pyrotechnic material is substantially smaller than the average diameter of the particles 112 of polymeric resin binder. The ratio of the average diameter of the particles 112 of polymeric resin binder to the average diameter of the particles 114 of pyrotechnic material is preferably in the range of about 20:1 to about 4:1More preferably, the ratio of the average diameter of the particles 112 of polymeric resin binder to the average diameter of the particles 114 of pyrotechnic material is about 8:1. The average diameter of the particles 114 of pyrotechnic material is preferably about 4 microns to about 50 microns. More preferably, the average diameter of the particles 114 of pyrotechnic material is about 10 microns.

The polymeric resin binder is a thermoplastic resin. The particles 112 of polymeric resin binder are bonded (fused) to each other by heating and softening (melting) portions 116 of adjacent particles 112 of polymeric resin binder. As shown in FIG. 4, the fused particles of polymeric resin binder form a binder matrix with voids between the particles 112 of polymeric resin binder. The voids are open to each other and form a network of interconnected open cells 118, thus giving the ignition droplet 46 a structure having interconnected open-cells 118.

The substantially smaller average diameter of the particles 114 of pyrotechnic material enables the particles 114 to be disposed or interspersed in the interconnected open cells 118 formed by the particles 112 of polymeric resin binder and create a combustible network of pyrotechnic material. By combustible network of pyrotechnic material, it is meant that the particles 114 of pyrotechnic material disposed in the interconnected open cells 118 are sufficiently close to one another to allow propagation of ignition of adjacent particles 114 throughout the interconnected open cells 118 upon ignition of the pyrotechnic material adjacent to the bridgewire 44. This results in a rapid, complete combustion of the pyrotechnic material.

The amount of polymeric resin binder in the present invention is that amount necessary to form a structure having interconnected open cells 118 in which the particles 114 of pyrotechnic material are disposed. Preferably, the amount of polymeric resin binder is about 50% or more by weight of the combined weight of pyrotechnic material and polymeric resin binder. More preferably, the amount of polymeric resin binder is about 70% to about 75% by weight of the pyrotechnic material and polymeric resin binder.

The amount of pyrotechnic material in the present invention is that amount necessary to form a combustible network of pyrotechnic material in the interconnected open cells 118 and to achieve sustained, rapid combustion of the pyrotechnic material upon ignition. Preferably, the amount of pyrotechnic material is less than about 50% by weight of the pyrotechnic material and the polymeric resin binder. More preferably, the amount of pyrotechnic material is about 25% to about 30% by weight of the pyrotechnic material and polymeric resin binder.

The polymeric resin binder of the present invention has a melting temperature below the autoignition temperature of the pyrotechnic material and above about 125° C., the maximum temperature at which an igniter for a vehicle protection apparatus is required to operate. Furthermore, the polymeric resin binder has a high melt viscosity as opposed to a low melt viscosity. A high melt viscosity allows the particles 112 of polymeric resin binder to retain their shape when melting and fuse to each other in a manner which permits the formation of the desired structure having interconnected open cells 118. A low melt viscosity would cause the particles 112 of polymeric resin binder to puddle or encapsulate the particles 114 of polymeric resin binder, which would prevent the pyrotechnic material from sustaining combustion upon ignition of the pyrotechnic material by the bridgewire.

Suitable polymeric resin binders for the present invention include nylon-based hot-melt adhesives. Examples of nylon-based hot-melt adhesives are "PLATAMID" H585 and "PLATAMID" M1309, which are available from Elf Atochem North America, Inc. "PLATAMID" H585 and "PLATAMID" M1309 are copolymers of high molecular weight polyamides with a solids content of 100 percent and a solvent content of zero. These polymeric resin binders have the advantage that they are neither brittle at a temperature of about −40° C. nor lose shape or configuration at a temperature of about 125° C. They are non-combustible at the ignition temperature of the pyrotechnic material.

Suitable pyrotechnic material for the present invention includes potassium dinitrobenzofuroxan (KDNBF), barium styphnate monohydrate (BARSTY), cis-bis-(5-nitrotetrazolato) tetraminecobalt(III)perchlorate (BNCP), 2-(5-cyanotetrazolato)pentaaminecobalt(III)perchlorate (CP), diazidodinitrophenol (DDNP), 1,1-diamino-3,3,5,5-tetrazidocyclotriphosphazene (DATA), cyclotetramethylenetetranitramine, lead azide, and lead styphanate. Preferably, the pyrotechnic material of the present invention is potassium dinitrobenzofuroxan (KDNBF).

When the igniter 24 is actuated, an actuating level of electric current is directed through the igniter 24 between the electrodes 40 and 42. As the actuating level of the electric current is conducted through the bridgewire 44, the bridgewire 44 generates heat which is transferred directly to the ignition droplet 46. The particles 114 of pyrotechnic material adjacent to the bridgewire 44 combust, resulting in complete combustion of the pyrotechnic material. Combustion of the pyrotechnic material produces combustion products, including heat, hot gases and hot particles, which ignite the main pyrotechnic charge 48. The pyrotechnic charge 48 then produces additional combustion products which are spewed outward from the igniter 24.

EXAMPLE

This Example illustrates preparation of an ignition droplet in accordance with the present invention.

23 mg of particulate potassium dinitrobenzofuroxan (KDNBF) and 69 mg of a particulate nylon-based hot-melt adhesive ("PLATAMID" H585 marketed by Elf Atochem North America, Inc.) were added to a mixing device ("POWERGEN" No. 35 manufactured by Powergen Inc.). The particles of potassium dinitrobenzofuroxan had an average diameter of about 10 microns and an autoignition temperature of about 211° C. The particles of "PLATAMID" H585 had an average diameter of about 80 microns and a melting point of about 140° C. to about 145° C.

The potassium dinitrobenzofuroxan and "PLATAMID" H585 were blended until the particles of potassium dinitrobenzofuroxan were uniformly dispersed with the particles of "PLATAMID" H585. Ethyl alcohol was added to the uniform mixture of potassium dinitrobenzofuroxan and "PLATAMID" H585 until a viscous slurry was formed. The viscous slurry of potassium dinitrobenzofuroxan and "PLATAMID" H585 was placed in an automated dispensing syringe. The dispensing syringe was positioned above the bridgewire of an igniter. A 35 mg ignition droplet was dispensed from the automated syringe by a LCC/DISPENSIT No. 20 dispensing valve onto the surface of the bridgewire at ambient temperature (25° C.). The ignition droplet, having a dough like consistency, flowed fully around the bridgewire to the dome-shaped configuration shown in FIG. 3, spreading to and covering portions of the header surface, electrode surface, and glass seal surface.

The droplet was heated to about 100° C. until the ethyl alcohol carrier liquid was driven off. The ignition droplet was then heated to a temperature of about 145° C. until the particles of "PLATAMID" H585 fused together (about 20 seconds). The ignition droplet had a structure of "PLATAMID" H585 with a network of interconnected open cells and a combustible network of KDNBF disposed in the interconnected open cells. The ignition droplet was neither brittle at −40° C. nor lost its shape or configuration at 125° C.

Advantages of the present invention should now be apparent. Primarily, the present invention takes advantage of the favorable processing characteristics of using a particulate polymeric resin binder and a particulate pyrotechnic material to form a structure having interconnected open cells of particulate polymeric resin binder with a combustible network of particulate pyrotechnic material disposed in the interconnected open cells. The formation of a structure having interconnected open cells in the ignition droplet allows for substantially lower loading of pyrotechnic material when compared to solvent based evaporative cured ignition droplets. The present invention requires less than 50% by weight loading of pyrotechnic material compared to greater than 90% by weight loading of pyrotechnic material for solvent based evaporative cured ignition droplets. The higher amount of binder provides an ignition droplet having greater mechanical strength.

From the above description of the invention, those skilled in the art will perceive improvements, changes and modifications. Such improvements, changes and modifications within the skill of the art are intended to be covered by the appended claims.

Having described the invention, the following is claimed:

1. An electrically actuatable igniter comprising:

a body;

a pair of electrodes associated with said body;

a heating element electrically connected between said electrodes; and an ignition droplet covering and adhering to said heating element, said ignition droplet comprising a particulate pyrotechnic material and a polymeric resin binder, wherein said polymeric resin binder is in the form of a matrix with voids, where the voids are open to each other and form a network of interconnected open cells, and wherein particles of said pyrotechnic material are disposed within said network of interconnected open cells and form a combustible network of said pyrotechnic material.

2. The igniter as defined in claim 1 wherein said polymeric resin binder has a melting point above about 125° C. and below the autoignition temperature of said pyrotechnic material.

3. The igniter as defined in claim 1 wherein said polymeric resin binder has a high melt viscosity.

4. The igniter as defined in claim 1 wherein the matrix having a network of interconnected open cells is formed by fusing together portions of adjacent particles of said polymeric resin binder.

5. The igniter as defined in claim 4 wherein the particles of said polymeric resin binder have a substantially uniform shape that is essentially spherical.

6. The igniter as defined in claim 4 wherein the particles of said polymeric resin binder have an average diameter of about 80 to about 200 microns.

7. The igniter as defined in claim 6 wherein the particles of said polymeric resin binder have an average diameter of about 80 microns.

8. The igniter as defined in claim 4 wherein the ratio of the average diameter of the particles of polymeric resin binder to the average diameter of the particles of pyrotechnic material is about 20:1 to about 4:1.

9. The igniter as defined in claim 4 wherein the ratio of the average diameter of the particles of polymeric resin binder to the average diameter of the particles of pyrotechnic material is about 8:1.

10. The apparatus as defined in claim 1 wherein said polymeric resin binder is a nylon-based hot-melt adhesive.

11. The apparatus as defined in claim 1 wherein said pyrotechnic material is selected from the group consisting of potassium dinitrobenzofuroxan, barium styphnate monohydrate, cis-bis-(5-nitrotetrazolato) tetraminecobalt (III)perchlorate, 2-(5-cyanotetrazolato) pentaaminecobalt (III) perchlorate, diazidodinitrophenol, 1,1-diamino-3,3,5,5-tetrazidocyclotriphosphazene, cyclotetramethylenetetranitramine, lead azide, and lead styphanate.

* * * * *